US006118967A

United States Patent [19]

Kagawa et al.

[11] Patent Number: 6,118,967

[45] **Date of Patent: *Sep. 12, 2000**

[54] TONER IMAGE FIXING DEVICE FOR PREVENTING CURLING OF RECORDING MEDIUM

[75] Inventors: Toshiaki Kagawa; Toshihiro Tamura, both of Sakurai; Shogo Yokota, Fujiidera, all of Japan

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/769,741

[22] Filed: Dec. 19, 1996

[30] Foreign Application Priority Data

Dec. 27, 1995 [JP] Japan ..... 7-340755

[51] Int. Cl.[7] ..... G03G 15/20

[52] U.S. Cl. ..... 399/328; 399/68; 399/69

[58] Field of Search ..... 399/67, 69, 328, 399/320, 330, 338; 219/216

[56] References Cited

U.S. PATENT DOCUMENTS

| | | | |
|---|---|---|---|
| 5,026,276 | 6/1991 | Hirabayashi et al. | 432/59 |
| 5,138,379 | 8/1992 | Kanazashi | 399/44 |
| 5,546,175 | 8/1996 | Uehara et al. | 399/328 |
| 5,563,696 | 10/1996 | Futagawa et al. | 399/69 |
| 5,621,512 | 4/1997 | Uehara et al. | 399/328 |
| 5,708,947 | 1/1998 | Kagawa et al. | 399/328 |
| 5,790,931 | 8/1998 | Tsuji et al. | 399/328 |
| 5,809,389 | 9/1998 | Tamura et al. | 399/330 X |

FOREIGN PATENT DOCUMENTS

| | | |
|---|---|---|
| 0635767 | 1/1995 | European Pat. Off. . |
| 55-36996 | 9/1980 | Japan . |
| 62135865 | 6/1987 | Japan . |
| 1-304481 | 12/1989 | Japan . |
| 6-83222 | 3/1994 | Japan . |
| 06308856 | 11/1994 | Japan . |
| 6-308856 | 11/1994 | Japan . |
| 07114283 | 5/1995 | Japan . |
| 8-106226 | 4/1996 | Japan . |
| 8-241000 | 9/1996 | Japan . |
| 8-262893 | 10/1996 | Japan . |

OTHER PUBLICATIONS

Patent Abstracts of Japan, vol. 095, No. 008, Sep. 29, 1995, and JP 07 114283 A May 2, 1995.

*Primary Examiner*—Quana Grainger
*Attorney, Agent, or Firm*—David G. Conlin; George W. Neuner

[57] ABSTRACT

Curling of edges of recording paper in a toner-image fixing device is prevented. A temperature control unit controls the operation of a heater-lamp for heating a fixing roller in such a way that the fixing roller temperature when the front edge of recording paper enters into the fixing device is lower than the fixing roller temperature when a tail end of the recording paper enters.

8 Claims, 8 Drawing Sheets

TONER IMAGE FIXING DEVICE FOR PREVENTING CURLING OF RECORDING MEDIUM

BACKGROUND OF THE INVENTION

The present invention relates to a toner image fixing device that is used in electrophotographic copying machines, facsimiles, printers and the like machines using electrophotographic process.

In conventional electrophotographic copying machines, facsimiles, printers and the like machines using electrophotographic process, there is usually used such a toner image fixing device that fixes a toner image on a recording medium (hereinafter described as recording paper) passing through nip portion formed between a fixing roller and a pressure roller, by heating either one or both rollers (hereinafter called "pressure roller type").

In the pressure roller type fixing device, paired rollers must rotate in synchronism with each other and must be rotatably supported. Therefore, the device has a complicated construction and is large and expensive to manufacture.

To solve the above-mentioned problems, the present applicant proposed a toner image fixing method that fixes a toner image on recording paper transferring through nip portion formed between a fixing roller and non-rotating pressure member used instead of a pressure roller (Japanese Patent Application No.7-44647 filed on Mar. 3, 1995). This method is hereinafter called as "pressure-pad type".

A pressure-pad type toner image fixing device has a fixing roller which is a thin-wall aluminum cylinder whose external surface is covered all over with a coat of excellent toner-releasing, paper-guiding heat-resistant synthetic resin, e.g., heat-resistant silicone rubber having a large friction coefficient, a pressure member which is disposed under the fixing roller and a heat-resistant sheet on interposed between the pressure member and the fixing roller. The heat-resistant sheet is made of a 100 micron thick glass fiber base coated or impregnated with toner-releasing and heat-resistant synthetic resin, e.g., fluorocarbon resin: PFA (Tetrafluoroethylene-fluoro-alkylvinylether copolymer), PTFE (Polytetrafluoro-ethylene) and FET (Polytetrafluoroethylene-Polytetra-fluoropropylene copolymer).

A recording paper with a not-yet-fixed toner image developed thereon passes nip portion formed between the fixing roller and the heat-resistant sheet for fixing the toner image thereon by fusing.

Problem To Be Solved

The pressure-pad type fixing device encounters a problem that the heat-resistant sheet causes a large amount of curling of a front edge of a recording sheet for the following reasons:

(1) In the conventional pressure roller type fixing device, the pressure roller has a large heat-capacity and can therefore heat the toner-image-carrying recording paper uniformly from the front edge to the tail end while the recording paper passes the fixing roller. The substantially even quality of the fixed toner image is obtained on the front end and the tail end of the recording paper. On the contrary, the pressure pad type fixing device uses a small heat-capacity fixing roller whose heat is transferred to a recording paper passing therethrough and which, therefore, can not evenly heat the recording paper. In other words, the tail portion of the recording paper is heated by a reduced heat from the fixing roller and therefore the toner image is is not applied uniformly to on the front portion and tail portion of the recording paper.

If the fixing temperature of the fixing roller is set at such a level that the toner image can be satisfactory fixed on the tail portion of the recording paper, the front end of the recording paper is excessively heated and curls up.

(2) In comparison with conventional pressure roller type method, the pressure pad type method provides wide nip portion for obtaining a high fixing quality of toner and therefore causes a large amount of curl of the front end of the recording paper.

SUMMARY OF THE INVENTION

It is an object of the present invention to provide a toner-image fixing device which is capable of effectively fixing a toner image on a recording paper and smoothly transferring the recording paper without curling of a front end of the paper.

It is an object of the present present invention to provide a toner image fixing device which is provided with a fixing roller, a pressure member disposed as pressed against a external cylindrical surface of a fixing roller, and a heat-resistant sheet interposed between the fixing roller for forming nip portion therebetween for introducing the recording medium carrying a toner image thereon and fixing the toner image on the recording medium by the fixing roller, and which is further provided with a temperature control portion for controlling a temperature of the fixing roller in such a manner that the fixing roller temperature when a front edge of the recording medium enters nip portion is set lower than a temperature of the fixing roller when a tail end of the recording medium enters the nip portion.

It is another object of the present invention to provide a toner image fixing device in which the temperature control portion is capable of setting a difference between the fixing roller temperatures when the front edge of the recording medium enters nip portion and when the tail end of the recording medium enters the nip portion, at a temperature in a range of 10° C. to 30° C.

Furthermore, a warm-up time of the fixing device can be shortened.

It is another object of the present invention to provide a toner image fixing device which is provided with a fixing roller, a pressure member disposed as pressed against a external cylindrical surface of a fixing roller, and a heat-resistant sheet interposed between the fixing roller for forming nip portion therebetween for introducing the recording medium carrying a toner image thereon and fixing the toner image on the recording medium by the fixing roller, and which is characterized in that the pressure member has a concave extending in a direction being normal to a entering direction of the recording medium into the nip portion of the fixing device.

It is another object of the present invention to provide a toner image fixing device which is characterized in that the pressure member is composed of two elastic members arranged at a specified distance from each other in the entering direction of the recording medium into the nip portion of the fixing device.

PREFERRED EMBODIMENT OF THE INVENTION

Figure 1:
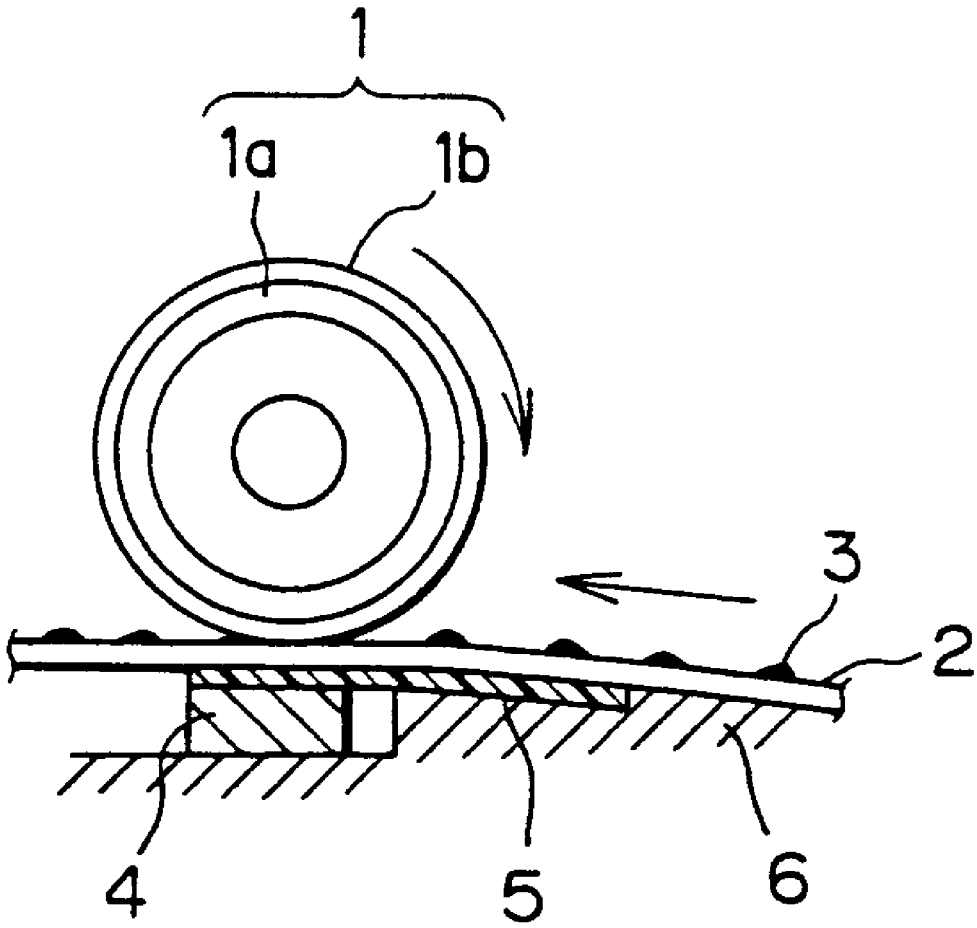
FIG. 1 ( PRIOR ART )
FIG. 1 is a construction view of a toner-image fixing device using a pressure pad type system, which was previously proposed by the applicant of the present invention.

Referring to FIG. 1, an example of a pressure-pad type toner image fixing device is explained as follows: A fixing roller 1 is a thin-wall aluminum cylinder 1*a* whose external surface is covered all over with a coat of excellent toner-releasing, paper-guiding heat-resistant synthetic resin 1*b*, e.g., heat-resistant silicone rubber having a large friction coefficient. A pressure member 4 is disposed under the fixing roller 1. A heat-resistant sheet 5 on a lower frame 6 is interposed between the pressure member 4 and the fixing roller 1. The heat-resistant sheet 5 is made of a 100 micron thick glass fiber base coated or impregnated with toner-releasing and heat-resistant synthetic resin, e.g., fluorocarbon resin: PFA (Tetra-fluoroethylene-fluoro-alkylvinylether copolymer), PTFE (Polytetrafluoro-ethylene) and FET (Polytetrafluoro-ethylene-Polytetra-fluoropropylene copolymer).

A recording paper 2 with a not-yet-fixed toner image 3 developed thereon passes nip portion formed between the fixing roller 1 and the heat-resistant sheet 5 for fixing the toner image thereon by fusing.

First Embodiment

Referring FIGS. 2 to 10, a preferred embodiment of the present invention will be described as follows:

A toner fixing device according to the present invention is now proposed for use in a laser printer.

Figure 2:
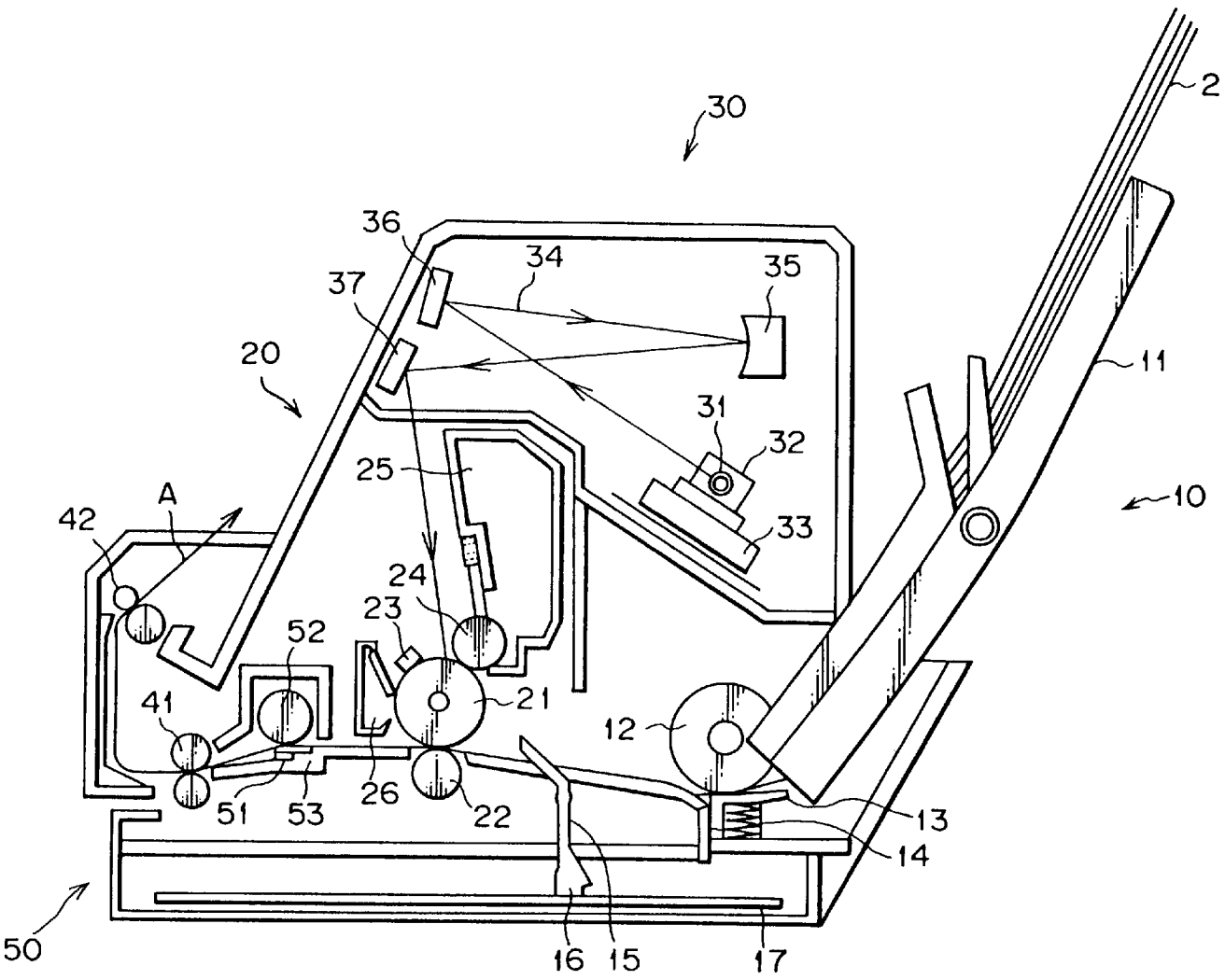
FIG. 2 is a schematic construction view of a laser printer in which the toner-image fixing device of FIG. 3 is used.

As shown in FIG. 2, the laser printer has a paper feeding portion 10, an image forming device 20, a laser scanning portion 30 and a toner image fixing device 50 embodying the present invention.

The paper feeding portion 10 feeds recording paper 2 into the image forming device 20 disposed in the printer body. The image forming device transfers a toner image onto the recording paper 2 that is further fed to the toner fixing device 50 wherein the toner image is fixed by heat on the recording paper 2. The recording paper with a toner image fixed thereon is then delivered out of the printer by delivery rollers 41 and 42. The path along which the recording paper traveled in the printer is shown by a bold line with an arrow A in FIG. 2.

The paper feeding portion 10 is composed of a paper feeding tray 11, a paper feeding roller 12, paper separating friction plate 13, pressure spring 14, paper sensor actuator 15, a paper sensor 16 and a control circuit 17.

When a command "Print" is given to the paper feeding portion 11, recording paper 2 piled on a paper feeding tray 11 is fed one by one by the effect of the paper feeding roller 12, paper feeding friction plate 13 and pressure spring 14 into the body of the printer. In the printer, the recording paper 2 kicks down the paper sensor actuator 15 that causes the optical paper-sensor 16 to generate an electrical signal to start an image printing process. The control circuit 17 driven by the section of the paper sensing actuator 15 transmits an image signal to a light-emitting laser diode unit 31 of the laser scanning portion 30 and controls the ON-OFF operation of the light-emitting diodes.

The laser scanning portion 30 comprises a light-emitting laser-diode unit 31, a scanning mirror 32, a scanning mirror motor 33 and reflecting mirrors 35, 36 and 37.

The scanning mirror 32 is driven by the scanning mirror motor 33 to rotate at a high constant rotation speed. In FIG. 2, laser light 34 scans in a vertical direction relative to the paper surface. The laser light 34 emitted from the light-emitting laser-diode unit 31, reflects by the reflecting mirrors 36, 35 and 37 in turn and falls onto a light-sensitive body 21. At this time, the laser light 34 selectively exposes the surface of the light-sensitive body 21 according to ON-OFF information given from the control circuit 17.

The image forming device 20 is composed of a light-sensitive body 21, an image transfer roller 22, an electrically charging member 23, a developing roller 24, a developing unit 25 and a cleaning unit 26.

The light-sensitive body's surface electrically charged in advance by the electrically charging member 23 is selectively discharged by the laser light 34 to form a latent image thereon. In the developing unit 25, toner stored therein is electrically charged by suitable stirring and is then fed to the developing roller 24 by which a toner image is formed on the light-sensitive body 21 according to the static latent image by the effect of a developing bias voltage given to the developing roller 24 and an electric field produced by potentials on the light-sensitive body 21.

The recording paper 2 fed by the paper feeding portion 10 enters a path between the light-sensitive body 21 and the image transfer roller 22. An image developed with toner on the light-sensitive body 21 is transferred onto the recording paper 2 by the effect of an electric field produced by a voltage applied to the image transfer roller 22 when the paper passes the path between the light-sensitive body 21 and the image transfer roller 22.

The recording paper 2 carrying the transferred thereon toner image is then fed to a toner image fixing device 50 wherein the recording paper 2 is suitably pressed by a pressure member 51 and, at the same time, is adequately pressed and heated by a fixing roller 52. The toner image is thus fixed by fusing on the recording paper 2. The recording paper 2 with the fixed toner image is delivered by the delivery rollers 41 and 42 out of the printing machine.

Figure 3:
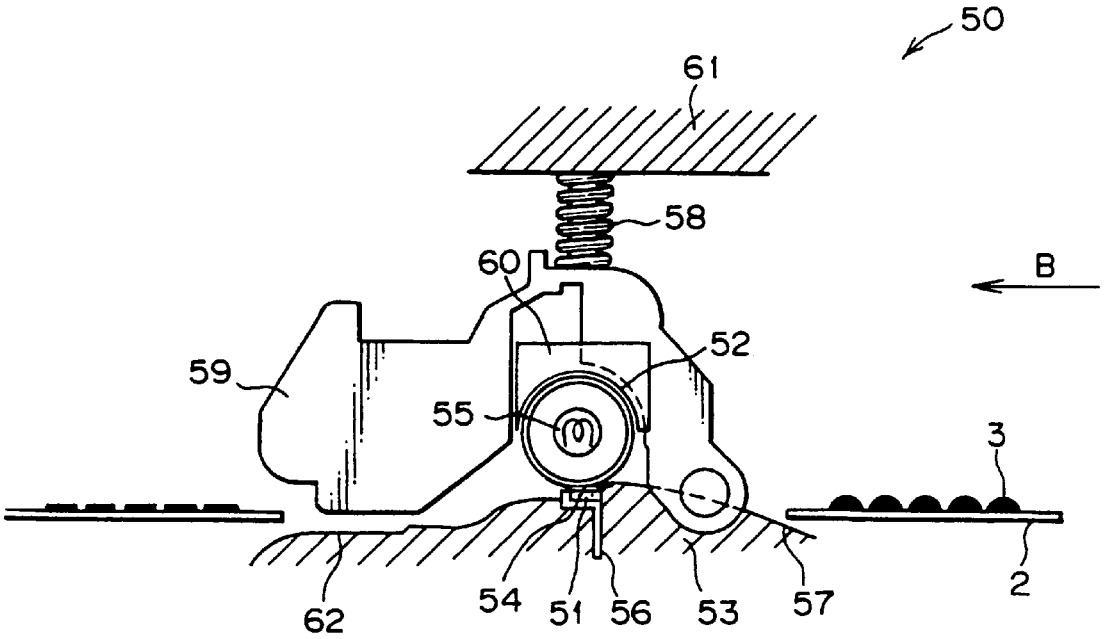
FIG. 3 is a construction view of a toner-image fixing device which is a first embodiment of the present invention.
Figure 4:
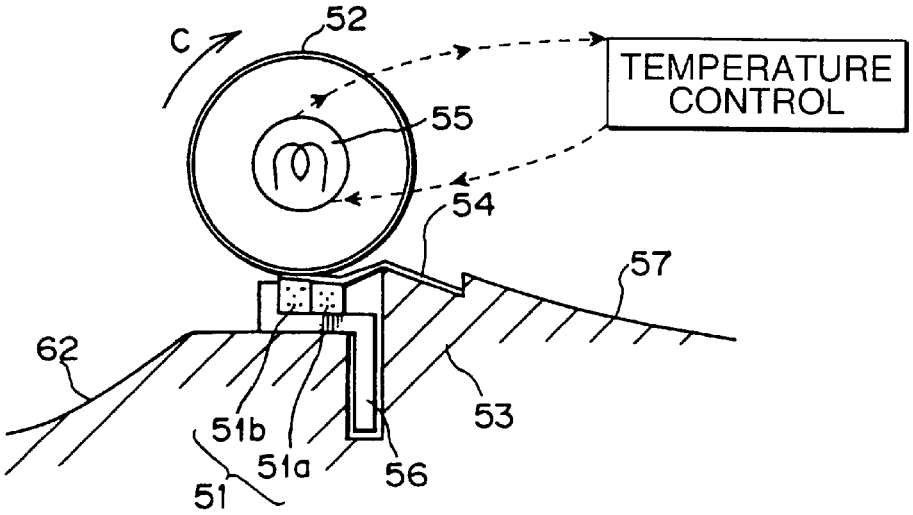
FIG. 4 is an enlarged view of an essential portion of the toner-image fixing device of FIG. 3.

Referring to FIGS. 3 and 4, the above-mentioned toner-image fixing device is described in detail as follows:

FIG. 3 is a general view of the toner image fixing device 50 and FIG. 4 is a detailed view of an essential portion of the toner-image fixing device 50.

As shown in FIG. 3, the toner fixing device 50 has a pressure member 51, a fixing roller 52 and a lower frame 53.

The fixing roller 52 has a thin-wall aluminum cylindrical body (outside diameter 14 mm and wall thickness 0.55 mm) externally covered with a baked coat of toner-releasable and heat-resistant syntheticresin, e.g., a mixture of fluorocarbon resin having an excellent toner-releasing property and fluoroelastomer having an excellent heat-resistant property. A heater-lamp 55 is coaxially inserted in the fixing roller body. The heater-lamp 55 heats the fixing roller 52 under the control of a temperature control portion (not shown).

The fixing roller 52 is supported at both ends on semicircular bearings 60 disposed at right angles to the axis of the fixing roller. The bearings 60 are fitted in a fixing cover 59 made of heat-resistant resin. The fixing cover 59 is pressed through pressure springs 58 (pressing force 1200 gf each) by an upper frame 61.

As shown in FIG. 4, the pressure member 51 is composed of two elastic members, one of which is a 2 mm thick and 2 mm wide silicon sponge-rubber member 51*a* disposed at an upstream side of the paper feeding path and the other is a 3 mm thick and 2 mm wide silicon sponge-rubber member 51*b* disposed at the downstream side of the paper feeding path. These pressure members 51*a* and 51*b* are arranged between a Z-bent metal plate 56 (1.2 mm thick stainless steel plate SUS) and an external cylindrical surface of the fixing roller 52 and pressed against the fixing roller by the force of the pressure springs 58. The pressure members 51*a* and 51*b* are secured to the Z-bent metal plate 56 by using a double coated adhesive tape (ET tape produced by Nissan Packing Company). The Z-bent metal plate 56 is engaged with bosses formed on the lower frame 53 at it's both ends.

A heat-resistant sheet 54 is secured to the lower frame 53 by a double coated adhesive tape and inserted between the upper pressure member 51 and the fixing roller 52. This heat-resistant sheet 54 is made of toner-releasing and heat-resistant synthetic resin, e.g., fluorocarbon resin such as PFA (Tetrafluoro-ethylene-fluoroalkylvinylether copolymer), PTFE (Poly-tetrafluoro-ethylene), which contains heat-resistant fillers (thickness 300 microns) such as carbon, molybdenum, graphite, boron nitride and polyimide.

A recording paper 2 carrying a toner image 3 to be fixed is transported in a paper-passing direction B indicated an arrow in FIG. 3 and enters, being guided by a guide 57, into nip portion formed between the fixing roller 52 and the heat-resistant sheet 54. While passing nip portion, the recording paper is heated with a pressure by the fixing roller with a result that the toner image 3 is fixed thereon to represent an image of characters and/or graphics. The recording paper passes along a guide 62 and then is discharged out of the printing machine. The final fixing step of the electrophotograpic process is thus completed.

The Z-shape of the bent metal plate is selected because it is effective prevent the pressure member from falling down when paper passes the fixing device as well as to increase the strength of the metal plate itself.

The method for controlling a temperature of the fixing roller 52, which is a main feature of the toner-image fixing device, will be explained below:

As described before, in the conventional pressure roller type fixing device, the pressure roller has a large heat-capacity and can therefore heat the toner-image-carrying recording paper uniformly from the front edge to the tail end while the recording paper passes the fixing roller. The substantially even quality of the fixed toner image is obtained on the front end and the tail end of the recording paper. On the contrary, the pressure-pad type fixing device uses a small heat-capacity fixing roller whose heat is transferred to a recording paper passing therethrough and which, therefore, can not evenly heat the recording paper. In other words, the tail portion of the recording paper is heated by a reduced heat from the fixing roller and therefore the toner image is fixed unevenly on the front portion and tail portion of the recording paper. If the fixing temperature of the fixing roller is set at such a level that the toner image can be satisfactory fixed on the tail portion of the recording paper, the front end of the recording paper is excessively heated and may suffer toner offset, curling, wrinkling and welting.

Figure 5:
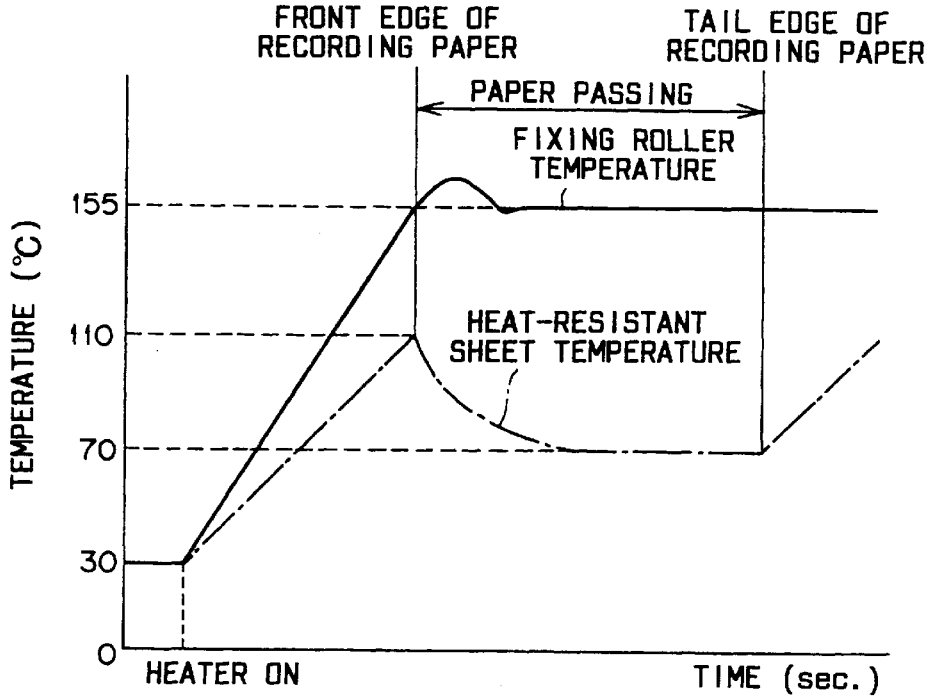
FIG.5 PRIOR ART
FIG. 5 is a view for explaining an example of method of controlling a surface temperature of a fixing roller for comparison with the present invention.

FIG. 5 shows a how to change the temperatures of the fixing roller 52 and the heat-resistant sheet 54. In this case, the temperatures of fixing roller 52 and the heat-resistant sheet 54 for heating the front end of the recording paper are set both at high temperatures.

Accordingly, a toner image fixing device according to the present invention conducts heating a fixing roller 52 by a heater-lamp 55 under the control of a temperature control portion in such a manner that the fixing roller temperature when the front end of the recording paper enters the nip portion is set lower than a temperature of the fixing roller when the tail portion of the recording paper enters the nip portion.

Figure 6:
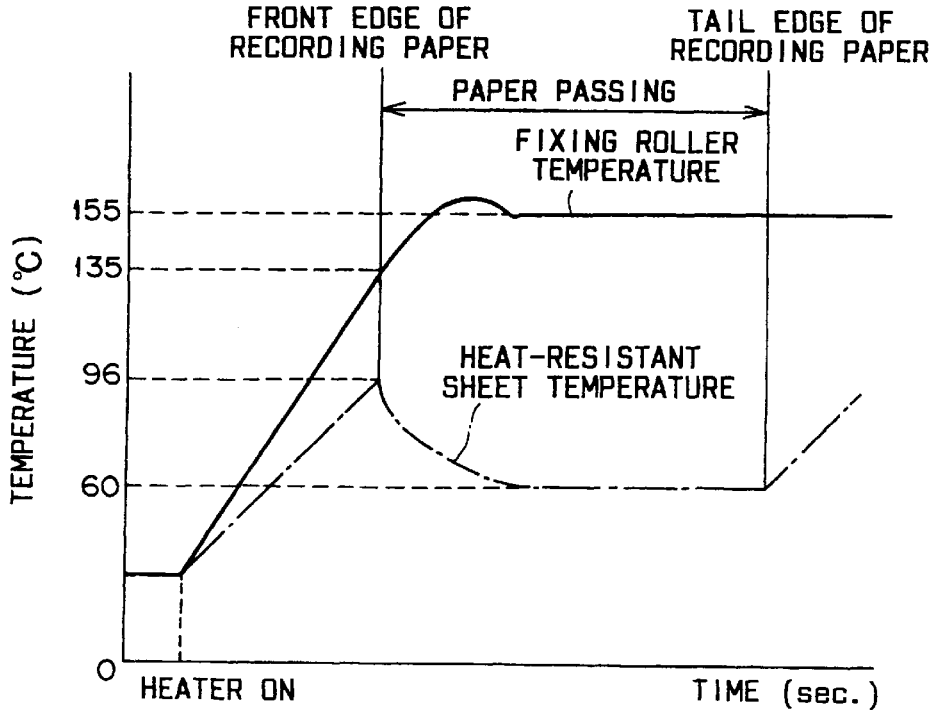
FIG. 6 is a view for explaining how to control a surface temperature of a fixing roller in a toner-image fixing device according to the first embodiment.
Figure 7:
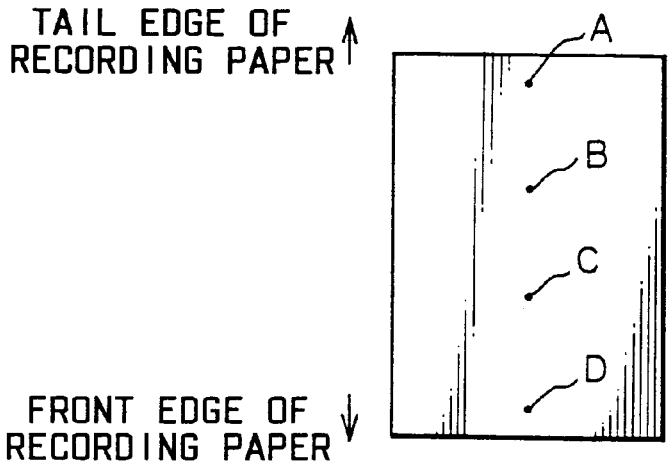
FIG. 7 illustrates measuring positions on a recording paper when determining a toner image fixing quality.

FIG. 6 is a graph showing a practical temperature control method. As the graph shows, a temperature of the fixing roller 52 at which the front edge of a recording paper enters the fixing device is set at a lower temperature (135° C. in the case of FIG. 6) than a specified fixing temperature (155° C.). (In this case, the recording paper is fed in such a timing that its front edge can enter the nip portion of the fixing device before the fixing roller gets the specified fixing temperature.)

Table 1 shows the results of examinations of fixing quality items (fixing quality, toner offset, wrinkle, welt and so on) on different portions of recording papers which toner images were fixed by two different temperature control methods: 155° C. (by method of FIG. 5) and 135° C. (by method of FIG. 6) at which the front edge of the recording paper. In Table 1, the toner-image fixing quality is examined at positions (A) to (D) on each recording paper shown in FIG. 7.

TABLE 1

| | First node (n1) | Second node (n2) | Third node (n3) | Fourth node (n4) |
|---|---|---|---|---|
| Input;HIGH (15V) | 15V | 15V | 10V | 5V |
| Input;LOW (0V) | 10V | 5V | 0V | 0V |

As shown in Table 1, the fixing device according to the present invention can suppress curling of the front edge of the recording paper and can also prevent occurrence of toner offset, wrinkle and welt.

Furthermore, the quality of a fixed toner image is even on different portions of the recording paper. This is because the front end of the recording paper enters into the nip portion of the fixing device and the toner image thereon fixed at a relatively low temperature of the fixing roller 52 but at a relatively high temperature of the heat-resistant sheet 54 whilst the toner image on the tail portion of the recording paper is fixed at an increased temperature of the fixing roller 52 but at a decreased temperature of the heat-resistant sheet 54.

A range of optimal temperature of the fixing roller when the front edge of recording roller enters into the nip portion of the fixing device was examined. The test results are shown in Table 2.

TABLE 2

| | MP6 | MP7 | MP8 | MN8 | MN7 | MN6 |
|---|---|---|---|---|---|---|
| Input;HIGH (15V) | 15V | 10V | 5V | 5V | 5V | 5V |
| Input;LOW (0V) | 10V | 10V | 10V | 10V | 5V | 0V |

Table 2 indicates that recording sheets can be free from toner-offset, wrinkle and welt, have a very small curl of their front edges and get a satisfactory fixing quality on their tail portion when the fixing roller temperature is in the range of 125 to 145° C. (lower than the fixing temperature 155° C. by 10–30°) at which the front edge of the recording paper enters into the nip portion of the fixing device.

As described above, the toner-image fixing device according to the present invention can effectively prevent occurrence of curling, toner offset, wrinkle and welt on the front end of the recording paper and obtain an evenly fixed toner image on the recording paper by controlling the fixing roller temperature in such a way that the fixing roller temperature when front edge of the paper enters into the fixing device are different from the fixing roller temperature when the tail portion of the paper enters thereinto. The warming-up time of the fixing device can be also saved by feeding a recording paper thereinto before the fixing roller 52 is heated up to a specified fixing temperature.

Any other temperature control method than the method shown in FIG. 6 may be applied if it can control the fixing roller temperature when the front edge of a recording paper enters the fixing device lower than the temperature when the tail portion of the recording paper appears into the fixing device.

Figure 8:
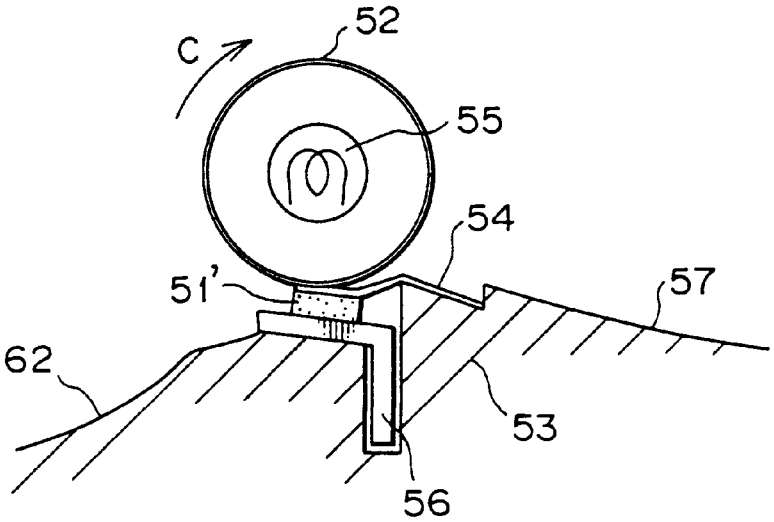
FIG. 8 is a construction view of a toner-image fixing device which uses another pressure member.

Although the above-mentioned embodiment uses the pressure member 51 having a stepped-shape, it may also adopt a pressure member 51' shown in FIG. 8. This pressure member 51' is composed of a 2 mm thick and 3 mm wide silicon sponge-rubber (TL4400 produced by Inoac Company). The pressure member 51' is disposed between an L-shape metal plate 56 (of stainless steel SUS304 of 1.2 mm in thickness) and a cylindrical body of a fixing roller 52 and pressed against the cylindrical surface of the fixing roller 52 by the effect of a pressure spring (not shown). The pressure member 51' is secured to the L-shape metal plate 56 by use of a heat-resistant double-coated adhesive tape (ET tape produced by Nissan Packing Company). The top surface of the L-shape metal plate 56, to which the pressure member 51' is secured, is slanting to the pressing direction. The pressure member 51' is therefore abutting on the fixing roller at an angle. Consequently, the pressure member 51' receives lower pressure at the paper inlet side and higher pressure at the paper outlet side. The nip width of this pressure member 51' is 1.5 mm that is equal to that of the stepped type pressure member 51 used in the embodiment 1.

Figure 9:
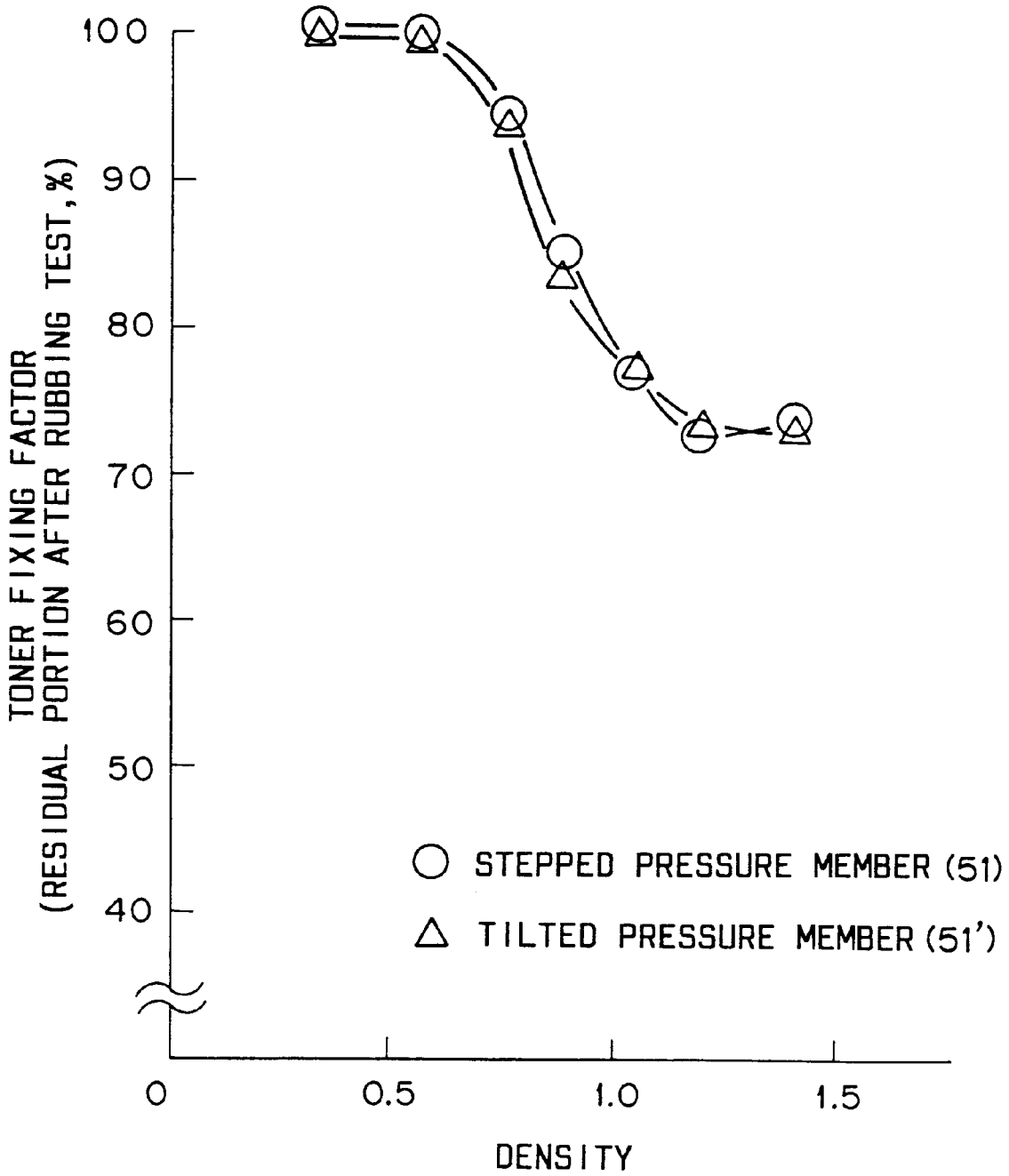
FIG. 9 is a view for comparing fixing factors obtained by using the pressure member of FIG. 8 and by using a stepped pressure member.
Figure 10:
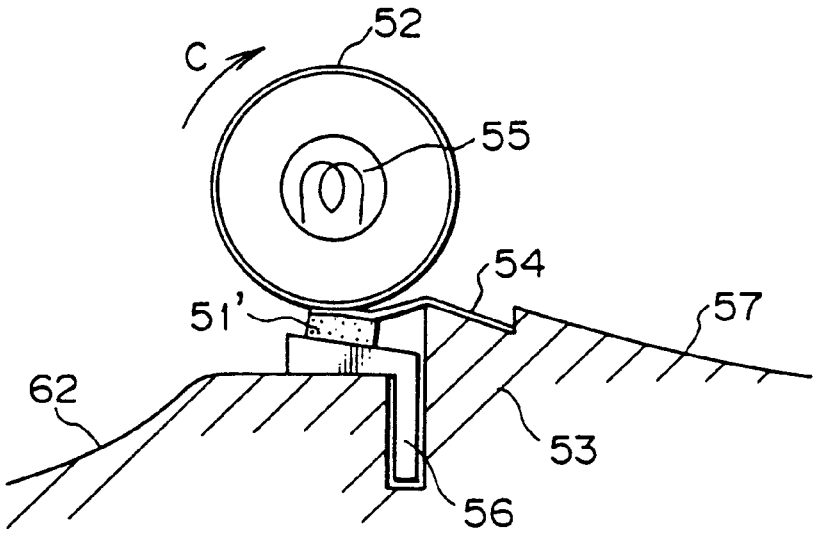
FIG. 10 shows another example of a toner image fixing device which uses a pressure member of FIG. 8.

FIG. 9 shows that the same fixing ability as obtained by using the stepped type pressure member 51 can be also obtained by using the pressure member 51'. As the inlet side pressure is small, the pressure member 51' can easily catch the front edge of a recording paper. In comparison with the stepped-type pressure member, the tilted pressure member 51' is simple in construction and obtain the same level of toner image fixing ability and paper clamping ability. Accordingly, application of the pressure member 51' makes it possible to simplify the construction of the fixing device and reduce the manufacturing cost of the device. The pressure member 51' is more stable than the stepped-type pressure member 51 and can be used only with the L-type metal plate. The L-shape metal plate 56 may be made of aluminum by drawing the latter into the cross-section shown in FIG. 10.

Second Embodiment

Figure 11:
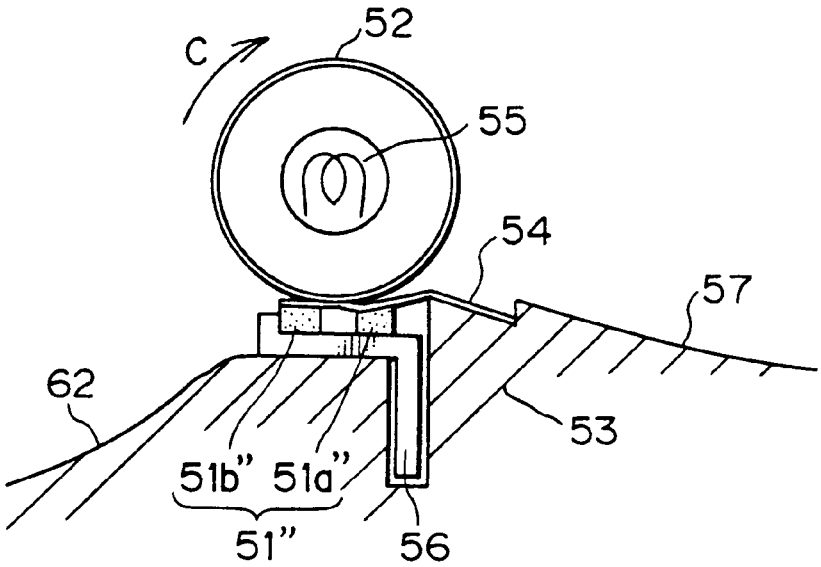
FIG. 11 is a construction view of a toner-image fixing device which is a second embodiment of the present invention.
Figure 12:
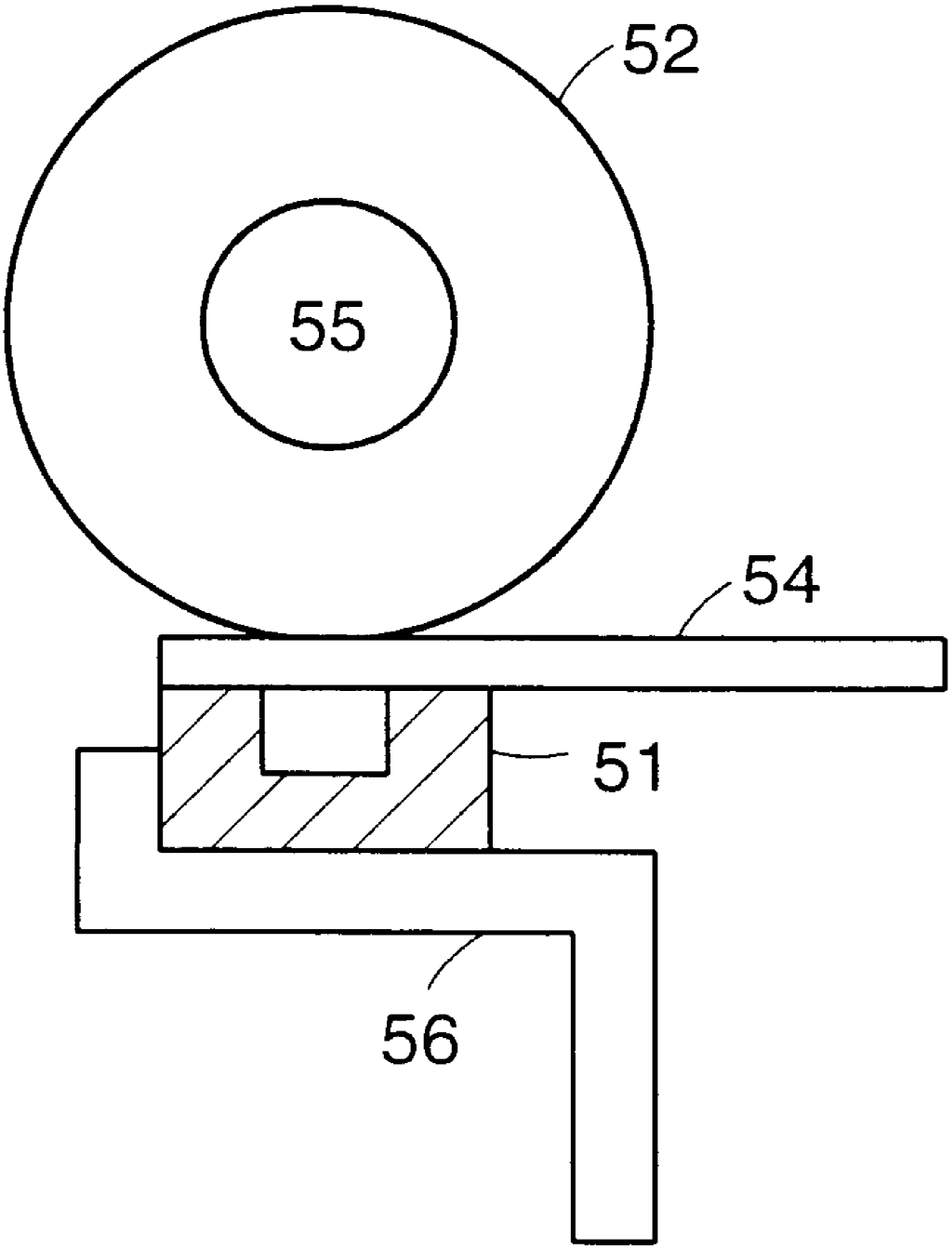
FIG. 12 is a side view of an alternative embodiment of the invention illustrating the concave pressure member.

Referring to FIG. 11, another embodiment of the present invention will be described as follows:

A fixing roller, heat-resistant sheet and other components of this device except a pressure member are the same those of the first embodiment. Therefore, they will not be further explained.

The pressure member 51" is composed of a 2 mm thick and 2 mm wide silicon sponge-rubber 51*a*" disposed at an upstream side of the paper feeding path and a 2 mm thick and 2 mm wide silicon sponge-rubber member 51*b*" disposed at the downstream side of the paper feeding path. These pressure member components 51*a*" and 51*b*" are arranged at a specified distance (2 mm in the shown case) and interposed between a Z-shape metal plate 56 (1.2 mm thick stainless steel SUS304) and the external cylindrical surface of a fixing roller 52. The lowest point of the fixing roller 52 exists between these two silicon sponge rubber components 51*a*" and 51*b*".

As the pressure member 51" is thus constructed, a heat-resistant sheet 54 mounted thereon can take the form matching the cylindrical surface of the fixing roller 52 and can therefore have a large contacting surface without being additionally pressed. Namely, the nip width can be increased. In practice, this embodiment attains nip width 2.5 mm that is larger than the nip width (1.5 mm) of the first embodiment. The pressure member 51" is hereinafter referred to as bridge type pressure member.

Table 3 shows a comparison of toner image fixing ability of a fixing device using the bridge type pressure member with that of a fixing device using the stepped type pressure member.

TABLE 3

| Fixing | Toner Image Fixing Quality | |
|---|---|---|
| Temperature (°C.) | Bridge type Pressure Member | Stepped Type Pressure Member |
| 130 | 74 | 70 |
| 135 | 79 | 75 |
| 140 | 85 | 80 |
| 145 | 95 | 86 |
| 150 | 100 | 90 |
| 155 | 100 | 95 |

1) The fixing quality was evaluated by residual ratio (%) after rubbing test.

As shown in Table 3, the fixing device using the bridge-type pressure member in comparison with the fixing device using the stepped-type pressure member can fix a toner image on a recording paper in wide nip portion. It can thereby obtain the improved quality of the fixed toner image on the recording paper. Accordingly, the fixing device with the bridge type pressure member can attain the same fixing ability at a fixing temperature lower by 10° C. in comparison with the fixing device using the stepped-type pressure member.

The use of the bridge-type pressure member can reduce curling of the front edge of the recording paper. Table 4 shows comparison of curls of the front edges of recording papers processed in the fixing device with the bridge-type pressure member and in the fixing device with the stepped-type pressure member.

TABLE 4

| Fixing | Curl of Font Edge of Paper (mm) | |
|---|---|---|
| Temperature (°C.) | Bridge type Pressure Member | Stepped Type Pressure Member |
| 130 | 0.5 | 1.1 |
| 135 | 0.6 | 1.3 |
| 140 | 0.7 | 1.6 |
| 145 | 0.7 | 1.9 |
| 150 | 0.8 | 2.2 |
| 155 | 0.8 | 2.7 |

As shown in Table 4, the bridge-type pressure member as compared with the stepped-type pressure member can reduce curling of the front edge of the recording paper. This is because the front edge of the recording paper curls downwards (in the reverse direction) in the nip portion on the first pressure component 51*a*" and curls upwards (in the positive direction). The curl size is thus corrected in total.

The toner-image fixing device using the bridge-type pressure member can reduce curling size of the front edge of each recording paper and can fix a toner image in wide nip portion, obtaining an improved quality of the fixed toner image on the recording paper.

Although the shown embodiment uses the pressure member 51" composed of two elastic parts disposed at a specified distance from each other, it is also possible to use, for example, a single elastic member having a central concave extending in its longitudinal direction.

As described above, the toner-image fixing devices according to the invention can control a temperature of the fixing roller at a low level when the front edge of each recording paper enters the fixing device, thereby preventing occurrence of curling, wrinkling, welting and toner offset on the front edge portion of the recording paper.

The front end of the recording paper enters into nip portion of the fixing device and toner image thereon is fixed at a relatively low temperature of the fixing roller and at a relatively high temperature of a heat-resistant sheet, whilst the toner image on the tail end of the recording portion is fixed at a relatively high temperature of the fixing roller and at a relatively low temperature of the heat-resistant sheet. Consequently, the toner image is evenly fixed on the frond and tail portions of the recording paper.

Furthermore, a warm-up time of the fixing device can be shortened.

In the toner-image fixing devices according to the invention, a front end of a recording paper is bent down (outward the fixing roller) when entering into nip between the pressure member and the fixing roller, and it is bent up (inward the fixing roller) when outgoing from nip between the pressure member and the fixing roller. The curl of the front end of the recording paper is thus compensated. In short, the curling of the recording sheet is prevented.

The heat-resistant sheet can be formed to match the external cylindrical surface of the fixing roller. In short, the heat-resistant sheet can form wider nip between the fixing roller and the sheet, improving the quality of the fixed toner image on the recording paper.

We claim:

1. A toner image fixing device, which is provided with a heated fixing roller, a pressure member disposed as pressed against an external cylindrical surface of a fixing roller, and a heat-resistant sheet interposed between the fixing roller and the pressure member for introducing a recording medium with a toner image thereon into a nip portion between the fixing roller and the pressure member and for fixing the toner image on the recording medium by the fixing roller, the toner image fixing device comprising temperature control means for setting T1<T2 wherein T1 is a temperature at the nip portion at a time when a head portion of a recording medium is introduced into the nip portion and T2 is a target temperature for fixing toner to a recording medium, and wherein the temperature control means controls the temperature at the nip portion to obtain a target temperature T2 subsequent to the head portion of the recording medium entering into the nip portion while the recording medium is in the nip portion.

2. A toner image fixing device as defined in claim 1, wherein the temperature control portion is capable of controlling a temperature of a heating lamp.

3. The toner image fixing device of claim 1, further comprising a temperature control portion for controlling T1<T2 and wherein the feeding timing control means responds to a temperature for controlling the timing of feeding the recording medium into the nip portion.

4. A toner image fixing device which is provided with a fixing roller, a non-rotatable pressure pad disposed as pressed against an external cylindrical surface of a fixing roller, and a heat-resistant sheet interposed between the fixing roller and the non-rotatable pressure pad for forming a nip portion therebetween for introducing the recording medium carrying a toner image thereon and fixing the toner image on the recording medium by the fixing roller, and which is characterized in that the non-rotatable pressure pad has a concave surface extending in a direction being normal to an entering direction of the recording medium into the nip portion of the fixing device.

5. A toner image fixing device which is provided with a fixing roller, a non-rotatable pressure pad disposed as pressed against an external cylindrical surface of a fixing roller, and a heat-resistant sheet interposed between the fixing roller and the non-rotatable pressure pad for forming a nip portion therebetween for introducing the recording medium carrying a toner image thereon and fixing the toner image on the recording medium by the fixing roller, and which is characterized in that the non-rotatable pressure pad has a concave surface extending in a direction being normal to an entering direction of the recording medium into the nip portion of the fixing device, wherein the non-rotatable pressure pad is composed of two elastic members arranged at a specified distance from each other in the entering direction of the recording medium into the nip portion of the fixing device.

6. A method for fixing a toner image on a recording medium in a toner image fixing device provided with a fixing roller, a pressure member disposed as pressed against an external cylindrical surface of a fixing roller, and a heat-resistant sheet interposed between the fixing roller and the pressure member for forming nip portion therebetween for introducing the recording medium carrying a toner image thereon and fixing the toner image on the recording medium by the fixing roller, the method comprising:

feeding the recording medium carrying a toner image thereon into the nip portion of the fixing device; and controlling a temperature of the fixing roller in such a manner that the fixing roller temperature when a front edge of the recording medium enters the nip portion is lower than a temperature of the fixing roller when a tail portion of the recording medium enters the nip portion and the fixing roller reaches a fixing temperature after a front edge of the recording medium enters the nip portion the toner image fixing device comprising temperature control means for setting T1<T2 wherein T1 is a temperature at the nip portion at a time when a head portion of a recording medium is introduced into the nip portion and T2 is a target temperature for fixing toner to a recording medium, and wherein the temperature control means controls the temperature at the nip portion to obtain a target temperature T2 subsequent to the head portion of the recording medium entering into the nip portion.

7. A toner image fixing method as defined in claim 6, further comprising controlling a temperature of a heating lamp.

8. A method for fixing a toner image on a recording medium in a toner image fixing device provided with a heated fixing roller and a pressure member disposed and pressed against an external cylindrical surface of the fixing roller, and a heat-resistant sheet interposed between the fixing roller and the pressure member, said method comprising:

introducing a recording medium with a toner image thereon into a nip portion between the fixing roller and the pressure member and fixing the toner image on the recording medium by the fixing roller, wherein the recording medium is introduced into the nip portion at a timing just before the surface temperature of the fixing roller reaches a target fixing temperature, and wherein the time difference between the timing of the introduction of the recording medium into the nip and the timing when the surface temperature of the fixing roller reaches the target fixing temperature is the time needed for the pressure member to become uniform in temperature.

* * * * *